US005306180A

United States Patent [19]

Buhr

[11] Patent Number: 5,306,180

[45] Date of Patent: Apr. 26, 1994

[54] ELECTRICAL CONNECTOR PROVIDED WITH AN ELECTRICAL INTERCONNECTION BETWEEN RESPECTIVE PORTIONS OF ITS CONTACTS

[75] Inventor: Alain Buhr, Sucy-En-Brie, France

[73] Assignee: Framatome Connectors International, Paris la Defense, France

[21] Appl. No.: 22,538

[22] Filed: Feb. 25, 1993

[30] Foreign Application Priority Data

Feb. 27, 1992 [FR] France ..... 92 02301

[51] Int. Cl.[5] ..... H01R 13/66

[52] U.S. Cl. ..... 439/620; 439/95

[58] Field of Search ..... 439/95, 620, 100, 840, 439/841

[56] References Cited

U.S. PATENT DOCUMENTS 3,181,044 4/1965 Duncan .
4,906,199 3/1990 Twomey et al. ..... 439/95
4,940,429 7/1990 Chambers et al. ..... 439/620 X

FOREIGN PATENT DOCUMENTS 0390426 10/1990 European Pat. Off. .

*Primary Examiner*—Eugene F. Desmond
*Attorney, Agent, or Firm*—Pollock, Vande Sande & Priddy

[57] ABSTRACT

An electrical connector comprises a plurality of contacts (6) held in respective housings (5) in an insulating body (4), interconnections being provided to electrically interconnect respective lengths (7) of the contacts (6) that are electrically insulated from the respective contact bodies. The interconnections comprise contact rings (8) surrounding the respective contact lengths (7) and made of an elastically-deformable conductive material, each of the rings being helically wound over at least half a winding turn around the corresponding length and being resiliently clamped thereon; two rigid plates (9) at least one of which is made of a conductive material and which are pierced by a multiplicity of holes (10) through which the contacts (6) of the connector can slide freely, the plates being disposed on either side of the contact rings; and clamping means (11, 12) for clamping the two plates together and resiliently compressing the contact rings in the longitudinal direction of the contacts.

8 Claims, 1 Drawing Sheet

ELECTRICAL CONNECTOR PROVIDED WITH AN ELECTRICAL INTERCONNECTION BETWEEN RESPECTIVE PORTIONS OF ITS CONTACTS

FIELD OF THE INVENTION

The present invention relates to improvements made to electrical connectors that include a plurality of contacts contained in respective housings in an insulating body received in a connector box, interconnection means being provided for electrically connecting together respective lengths of the contacts which are electrically insulated from respective contact bodies.

In the type of connector concerned, contacts are provided with respective auxiliary components that are tubular in shape (e.g., a filter component, a clipping component, a varistor, etc.). Each such component is integrated in the corresponding contact body and needs to be connected to an electrical potential that is different from the potential of the contact body (and in particular to ground potential). The tubular component is received in an annular recess of the contact body in such a manner that continuity of the outer surface of the contact is ensured. In the description below, where the contact is considered purely from an external point of view, the term "contact length" is used to designate this particular portion integrated in the contact.

BACKGROUND OF THE INVENTION

When an electrical interconnection is desired between all of the respective contact lengths (e.g., for grounding purposes), the interconnection is obtained by means of a metal plate (referred to as the ground plate) which is pierced by holes each having a contact passing therethrough. Each hole is lined by a plurality of spring blades that are pushed away from the face of the plate and that define a passage that is narrower than the diameter of the contact: these lips thus bear resiliently against the contact length where it passes through the hole.

That solution has the advantage of being easy to manufacture since the plate is obtained by a cutting out and embossing operation which is cheap.

However, that solution suffers from a significant drawback relating to the fact that the blades that are curved in the contact insertion direction (generally from the back towards the front) of the supporting insulating body bear resiliently against the contact-like catches that tend to prevent the contact from being withdrawn from the insulating body (generally from the front towards the back). When it is necessary to extract a contact (e.g., in order to replace it), such extraction gives rise to irreversible deformation, thereby irremediably damaging the lip blades, thus requiring the plate to be replaced as well since it has become unusable. Consequently, withdrawing a single contact requires all of the contacts to be disassembled and the grounding plate to be replaced with all of the contacts then being reassembled, which operation is lengthy, cumbersome, and expensive.

SUMMARY OF THE INVENTION

A particular object of the invention is to provide a technical solution enabling the drawback of the prior art structure to be avoided while also obtaining the additional advantage of the means implemented having general dimensions that are identical to those of the grounding plates used in the past, thereby enabling them not only to be used in connectors now being manufactured, but also enabling them to be installed in pre-existing connectors, replacing the present grounding plate.

To these ends, the present invention provides an electrical connector of the above-specified type which is essentially characterized in that said interconnection means comprise:

contact rings surrounding respective ones of the contact lengths and each constituted by an elastically-deformable electrically-conductive material, each of the rings being wound helically and occupying at least half a winding turn around the corresponding length and clamping resiliently thereto;

two rigid plates, at least one of which is made of an electrically-conductive material, both plates being pierced by a multiplicity of holes through which the contacts of the connector can slide freely, the plates being disposed on either side of the contact rings; and clamping means for clamping the two plates towards each other and resiliently compressing the contact rings in the longitudinal direction of the contacts.

By means of this disposition, none of the contacts is subjected to a locking force in a special direction and it is possible to withdraw a contact (e.g., by extracting it through the back of the connector), and then to insert a new contact, without damaging any of the other component parts. A contact can be replaced (e.g. after being damaged) simply and quickly, and connector maintenance is much less expensive.

Advantageously, each contact ring extends helically over a length lying in the range three-fourths of a winding turn and one full turn, in such a manner as to exert sufficient clamping force on the contact length, thereby ensuring good electrical contact while simultaneously being secured on the contact regardless of its compression state.

BRIEF DESCRIPTION OF THE DRAWINGS

The will be better understood on reading the following detailed description of a preferred embodiment given solely by way of example. In the description, reference is made to the accompanying drawings, in which.

DESCRIPTION OF THE PREFERRED EMBODIMENT

Figures 1, 2A, 2B:
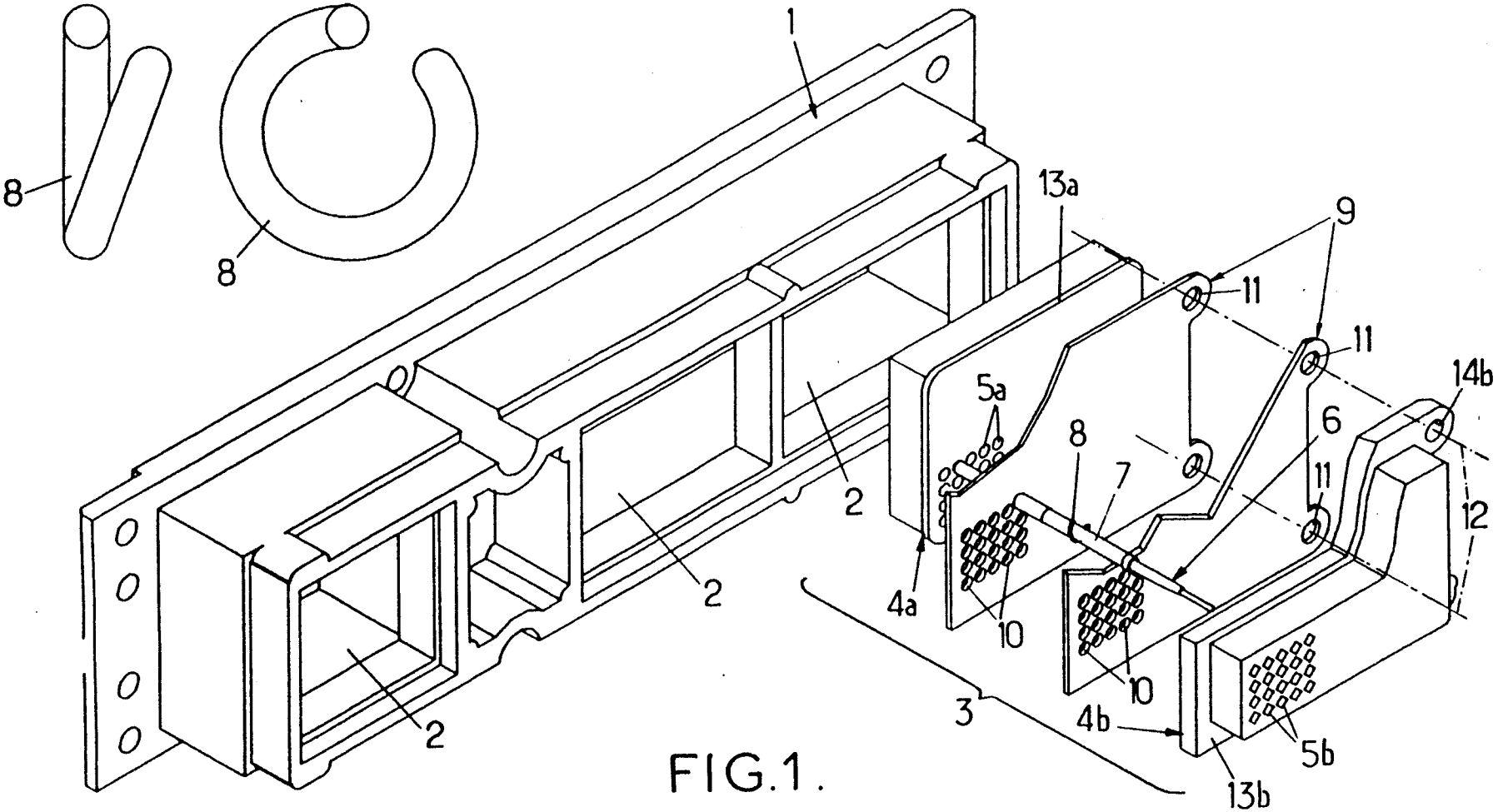
FIG. 1 is an exploded perspective view showing an electrical connector organized in accordance with the invention.
FIGS. 2A and 2B are respectively a side view and a front view on a larger scale of a component part of the FIG. 1 connector.

FIG. 1 shows the essential components of an electrical connector having a large number of contacts, being a connector of the type which would appear to be most concerned by the dispositions of the invention, even though from the purely technical point of view these dispositions are equally capable of being implemented in connectors having a small number of contacts.

The connector comprises a rectangular box 1 of the type constituting a base for fixing to a support, and it is organized to present a plurality of housings 2 each designed to receive a respective contact block 3, only one of which is shown. Each contact block 3 is generally in the form of a parallelepiped and is retained in its housing 2 in any appropriate manner known to those skilled in the art. The organization shown is given merely by way of example in order to give a concrete idea, and the dispositions specific to the invention as described below are equally capable of being used in electrical connectors of other types (in particular cylindrical connectors).

Contact block 3 comprises an insulating body 4 pierced by a multiplicity of housings 5 suitable for receiving respective electrical contacts 6 (in this case of the male type, with active terminations in the form of pins), the housings 5 and the contacts 6 being configured so that the contacts are inserted into the housings or are extracted therefrom via the back ends of the housings. The contacts are held in the housings in any manner known to those skilled in the art.

The insulating body 4 is constituted in the form of two insulating blocks, insulating block **4*a* provided with housings 5*a* being situated towards the back and insulating block 4*b* provided with housings 5*b*** being situated towards the front.

In addition, each of the contacts 6 includes a tubular length 7 which is electrically insulated from the contact body and which may be taken to an electrical potential differing from that of the contact body (e.g., a filter contact, a thyristor contact, etc.). The length 7 extends approximately level with the interface between the two insulating blocks **4*a* and 4*b*** when the contacts are in the assembled position.

Each length 7 is surrounded by a respective contact ring 8 which is shown on a larger scale in FIGS. 2A and 2B. Each contact ring 8 is constituted by an electrically-conductive material that is elastically-deformable (e.g., treated beryllium bronze, with silver plating to improve conductivity) and is wound helically to extend around at least half a turn (and preferably to extend around three-fourths of a turn to one complete turn, as shown in FIGS. 2A and 2B), clamping resiliently onto the length 7.

Two rigid clamping plates 9 are disposed on either side of the contact rings 8, with at least one (and preferably both) of the clamping plates 9 being made of an electrically-conductive material, and in particular of a metal that is a good conductor of electricity (e.g., brass). The plates 9 are pierced by a multiplicity of holes 10 that coincide with the holes **5*a* and 5*b* in the insulating blocks, and of dimensions suitable for allowing the contacts 6 to slide freely therethrough while retaining the contact rings 8**.

Finally, clamping means are associated with the plates 9 to clamp them towards each other so as to compress the contact ring 8 between them, resiliently and without crushing them. To this end, the plates 9 may have holes 11 (situated in the corner of the plates in this case) through which clamping screws are installed (represented by chain-dotted lines 12). The insulating blocks **5*a* and 5*b* are preferably mechanically associated with the plates 9. To this end, each of them has an insulating thrust plate respectively referenced 13*a* and 13*b* that comes into contact with a corresponding clamping plate 9. Thrust plate 13*b* of front insulating body 9*b* is also provided with holes 14*b* at its corners for receiving the clamping screws 12. In this configuration, the clamping screws are screwed into the box 1, and bearing against the thrust plate 13*b* they compress and hold together the stack of all of the components in the corresponding housing 2**.

An electrical connection is thus established between each contact ring 8 and the associated length 7, and also between each contact ring 8 and one or both of the plates 9. All of the contact lengths 7 are thus connected to the same electrical potential which is that of the plate(s) 9. The plates are connected by connection means (not shown) to a determined electrical potential, e.g., electrical ground. For example, such a connection may be made via one of the contacts of the block 3 which is not provided with the length 7, but with which the plate(s) 9 is/are in electrical connection in the same way as with the lengths 7 of the other contacts.

By means of this disposition, any one of the contacts 6 may be individually extracted from the insulating block 4 (in this case via the back thereof) without damaging any other component parts, and a new contact can be inserted in the same way (in this case from the back). The operation of replacing a damaged or defective contact is thus simpler and quicker than it is with a prior art connector, and above all there is no need to dismantle the contact block completely and replace the electrical interconnection parts as used to be the case.

Finally, the clamping plates 9 can be very thin (e.g., 0.8 mm thick) and each contact ring 8 in its compressed position may also be very thin (e.g., 0.3 mm) such that the overall thickness of the interconnection parts remains substantially the same (about 1.2 mm) as that of a grounding plate as used in the past. As a result, the means of the invention can be installed in a pre-existing connector, replacing the grounding plate with which it was originally fitted.

Naturally, and as can be seen from the above, the invention is not limited in any way to those applications and implementations that have been mentioned more specifically. On the contrary, it extends to any variants thereof. In particular, it may be observed that although each ring described above is specified as constituting a portion of a helix that has a circular projection (since it is likely that that will be the shape used most commonly), it is also possible to provide rings that have projections of different shapes, which shapes may have continuous curvature (such as an ellipse, an oval, . . . ), or may be polygonal in outline (in particular square, rectangular, hexagonal, . . . ).

I claim:

1. An electrical connector including a plurality of contacts (6) held in respective housings (5) in an insulating body (4) received in a connector box (1), interconnection means being provided to electrically connect together respective lengths (7) of said contacts (6) that are electrically insulated from the respective bodies of the contacts, wherein said interconnection means comprise:

contact rings (8) surrounding respective ones of said contact lengths (7) and each constituted of an elastically-deformable electrically-conductive material, each of said rings (8) being wound helically and occupying at least half a winding turn around the corresponding length and clamping resiliently thereto;

two rigid plates (9), at least one of which is made of an electrically conductive material, both plates being pierced by a multiplicity of holes (10) through which the contacts (6) of the connector can slide freely, said plates (9) being disposed on either side of the contact rings (8); and clamping means (11, 12) for clamping the two plates (9) towards each other and resiliently compressing the contact rings (8) in the longitudinal direction of the contacts;

whereby electrical interconnection is established between each of said contact lengths and each conducting rigid plate via said rings, and whereby each contact may be individually dismantled without it being necessary to involve the other contacts.

2. An electrical connector according to claim 1, wherein each contact ring (8) extends helically over a length lying in the range three-fourths of a winding turn to one full turn.

3. An electrical connector according to claim 1, wherein the contact rings (8) are made of metal.

4. An electrical connector according to claim 1, wherein the conducting clamping plate (9) is made of metal.

5. An electrical connector according to claim 1, wherein both clamping plates (9) are conducting.

6. An electrical connector according to claim 1, including electrical connection means for electrically-connecting the clamping plate (9) of electrically conductive material to the electrical ground of the connector.

7. An electrical connector according to claim 1, wherein the insulating body (4) is made up in the form of two insulating blocks (4*a*, 4*b*) disposed on either side of the clamping plates (9) and the clamping means (14*b*, 12) are supported by said insulating blocks in such a manner that clamping said insulating blocks causes said plates to be clamped together.

8. An electrical connector according to claim 7, wherein the facing faces of the two insulating blocks (4*a*, 4*b*) are implemented in the form of respective thrust plates (13*a*, 13*b*) suitable for pressing uniformly against the adjacent clamping plates (9).

* * * * *